US008052261B2

(12) United States Patent
Sasaki et al.

(10) Patent No.: US 8,052,261 B2
(45) Date of Patent: Nov. 8, 2011

(54) INK CARTRIDGE DETERMINATION SYSTEMS AND INK CARTRIDGES

(75) Inventors: Toyonori Sasaki, Anjo (JP); Shingo Hattori, Nagoya (JP); Hirotake Nakamura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 463 days.

(21) Appl. No.: 12/326,072

(22) Filed: Dec. 1, 2008

(65) Prior Publication Data

US 2009/0073199 A1 Mar. 19, 2009

Related U.S. Application Data

(63) Continuation-in-part of application No. 11/863,147, filed on Sep. 27, 2007, now Pat. No. 7,562,972.

(30) Foreign Application Priority Data

Jan. 30, 2007 (JP) ..... 2007-018806
Mar. 28, 2007 (JP) ..... 2007-083778
Mar. 30, 2007 (JP) ..... 2007-094759
Nov. 30, 2007 (JP) ..... 2007-311791

(51) Int. Cl.
*B41J 2/175* (2006.01)

(52) U.S. Cl. ..... 347/86; 347/7; 347/19

(58) Field of Classification Search ..... 347/19, 347/84, 85, 86, 7
See application file for complete search history.

(56) References Cited

U.S. PATENT DOCUMENTS 5,506,611 A 4/1996 Ujita et al.
6,062,667 A 5/2000 Matsui et al.
6,312,084 B1 11/2001 Ujita et al.
7,188,939 B1 3/2007 Sasaki
7,562,972 B2 * 7/2009 Hattori et al. ..... 347/86
7,690,773 B2 * 4/2010 Hattori et al. ..... 347/86
2005/0195225 A1 9/2005 Takagi et al.
2007/0070153 A1 3/2007 Hattori et al.

(Continued)

FOREIGN PATENT DOCUMENTS

EP 1097814 A2 11/2000

(Continued)

OTHER PUBLICATIONS

European Patent Office, European Search Report for Related EP Application No. 08003693 dated Mar. 7, 2008.

*Primary Examiner* — Huan Tran
(74) *Attorney, Agent, or Firm* — Baker Botts L.L.P.

(57) ABSTRACT

An ink cartridge determination system includes a cartridge mounting portion, an optical sensor positioned at the cartridge mounting portion, at least one ink cartridge configured to be inserted into the cartridge mounting portion, and a determiner. The optical sensor includes a light-emitting element and a light-receiving element. The optical sensor is configured to selectively output a first signal and a second signal based on an intensity of the light received by the light-receiving element. The at least one ink cartridge includes a first light altering portion, a second light altering portion, and a light passing portion, which are configured to sequentially intersect a optical path of the optical sensor when the at least one ink cartridge is inserted into the cartridge mounting portion, and the determiner is configured to determine a type of the at least one ink cartridge based on a time profile of a signal outputted from the optical sensor.

16 Claims, 11 Drawing Sheets

U.S. PATENT DOCUMENTS

2007/0229615 A1 10/2007 Hattori et al.

FOREIGN PATENT DOCUMENTS

| | | | | |
|---|---|---|---|---|
| EP | 1241011 | A2 | | 3/2002 |
| EP | 1792736 | A1 | | 9/2004 |
| EP | 1772270 | A2 | | 6/2006 |
| EP | 1839871 | A1 | | 6/2006 |
| EP | 1839873 | A1 | | 9/2006 |
| EP | 1864815 | A1 | | 6/2007 |
| EP | 1886821 | A2 | | 8/2007 |
| EP | 2103434 | | * | 9/2009 |
| JP | 3213349 | A | | 9/1991 |
| JP | 2005-254734 | A | | 9/2005 |
| WO | 2006062254 | A1 | | 6/2006 |

* cited by examiner

T0
T1
T2
T3
ΔT11

HIGH
LOW
ΔT12

HIGH
LOW

INK CARTRIDGE DETERMINATION SYSTEMS AND INK CARTRIDGES

CROSS-REFERENCE TO RELATED APPLICATION

The present application is a continuation in part application of U.S. patent application Ser. No. 11/863,147 ("the '147 application"), which was filed on Sep. 27, 2007, and claims priority from Japanese Patent Application No. JP-2007-311791, which was filed on Nov. 30, 2007, and the '147 application, the disclosures of which are incorporated herein by reference in their entirety.

BACKGROUND OF THE INVENTION

1. Field of the Invention

The present invention relates generally to ink cartridge determination systems configured to determine a type of an ink cartridge, in which the ink cartridge is configured to be inserted into a cartridge mounting, and to such ink cartridges.

2. Description of Related Art

A known ink-jet recording apparatus is configured to dispense ink onto a sheet of paper to record an image thereon. The known ink-jet recording apparatus has a recording head. The recording head is configured to selectively eject ink from nozzles to the sheet of paper. A known ink cartridge is configured to be detachably mounted to the ink-jet recording apparatus. The ink cartridge has an ink chamber configured to store ink therein, and ink is supplied from the ink chamber to the recording head when the ink cartridge is mounted to the ink-jet recording apparatus.

Another known ink-jet recording apparatus, such as the ink-jet recording apparatus described in JP-A-3-213349, is configured to determine the type of ink stored in another known ink cartridge, which is configured to be used with the ink-jet recording apparatus. The another known ink cartridge has a flag member configured to block light. The position of the flag member varies according to the type of ink stored in the ink cartridge. The flag member is configured to be positioned in an optical path of an optical sensor of the another known ink-jet recording apparatus when the ink cartridge is mounted to the ink-jet recording apparatus. The position of the flag member is detected by the optical sensor, and thereby, the type of ink is determined.

Nevertheless, the another known ink cartridge requires a flag member and a mechanism for selectively protruding the flag member from the ink cartridge and for accommodating the flag member in the ink cartridge. Therefore, the structure of the another known ink cartridge is complicated. Moreover, if the mechanism fails to protrude the flag member from the ink cartridge, the type of ink cannot be determined.

SUMMARY OF THE INVENTION

Therefore, a need has arisen for ink cartridge determination systems that overcome these and other shortcomings of the related art. A technical advantage of the present invention is that a type of an ink cartridge reliably is determined without complicating the structure of the ink cartridge.

According to an embodiment of the present invention, an ink cartridge determination system comprises a cartridge mounting portion, an optical sensor positioned at the cartridge mounting portion, at least one ink cartridge configured to be inserted into the cartridge mounting portion in an insertion direction, and a determiner. The optical sensor comprises a light-emitting element configured to emit light and a light-receiving element configured to receive the light emitted from the light-emitting element, wherein an optical path is formed between the light emitting element and the light-receiving element. The optical sensor is configured to output a first signal when an intensity of the light received by the light-receiving element is greater than a threshold value, and to output a second signal when the intensity of the light received by the light-receiving element is less than or equal to the threshold value. The at least one ink cartridge comprises a first light altering portion configured to permit a first amount of the light emitted from the light-emitting element to reach the light-receiving element, wherein an intensity of the first amount is less than or equal to the threshold value, a second light altering portion configured to permit a second amount of the light emitted from the light-emitting element to reach the light-receiving element, wherein an intensity of the second amount is less than or equal to the threshold value, and a light passing portion configured to allow a third amount of the light emitted from the light-emitting element to pass therethrough, wherein an intensity of the third amount is greater than the threshold value. The first light altering portion, the light passing portion, and the second light altering portion are configured to sequentially intersect the optical path of the optical sensor when the ink cartridge is inserted into the cartridge mounting portion. The determiner is configured to determine a type of the at least one ink cartridge based on a time profile of a signal outputted from the optical sensor during the insertion of the at least one ink cartridge into the cartridge mounting portion.

According to another embodiment of the present invention, an ink cartridge comprises a first light altering portion configured to permit a first amount of a light coming from a first side of the ink cartridge to reach a second side of the ink cartridge opposite the first side of the ink cartridge, a second light altering portion configured to permit a second amount of the light coming from the first side of the ink cartridge to reach the second side of the ink cartridge, and a light passing portion configured to permit a third amount of the light coming from the first side of the ink cartridge to reach the second side of the ink cartridge. An intensity of the first amount is less than or equal to a predetermined value, an intensity of the second amount is less than or equal to the predetermined value, and an intensity of the third amount is greater than the predetermined value. The first light altering portion, the light passing portion, and the second light altering portion are configured to sequentially intersect an optical path of the light.

Other objects, features, and advantages of embodiments of the present invention will be apparent to persons of ordinary skill in the art from the following description of embodiments with reference to the accompanying drawings.

BRIEF DESCRIPTION OF DRAWINGS

For a more complete understanding of the present invention, the needs satisfied thereby, and the objects, features, and advantages thereof, reference now is made to the following description taken in connection with the accompanying drawings.

DETAILED DESCRIPTION OF EMBODIMENTS

Figure 1:
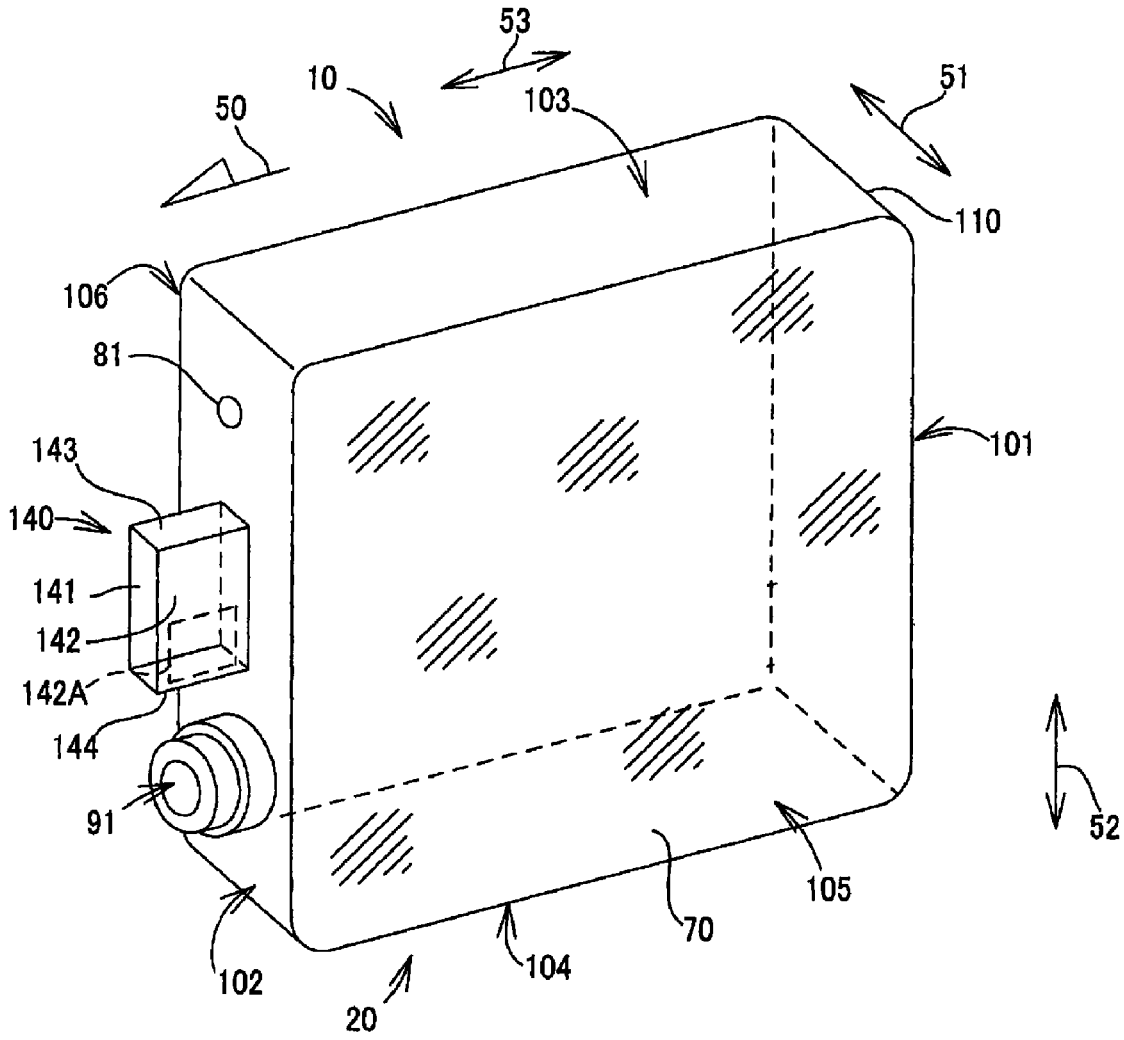
FIG. 1 is a perspective view of an ink cartridge, according to an embodiment of the present invention.

Embodiments of the present invention and their features and technical advantages may be understood by referring to FIGS. 1-11, like reference numerals being used for like corresponding portions in the various drawings.

Figure 2B:
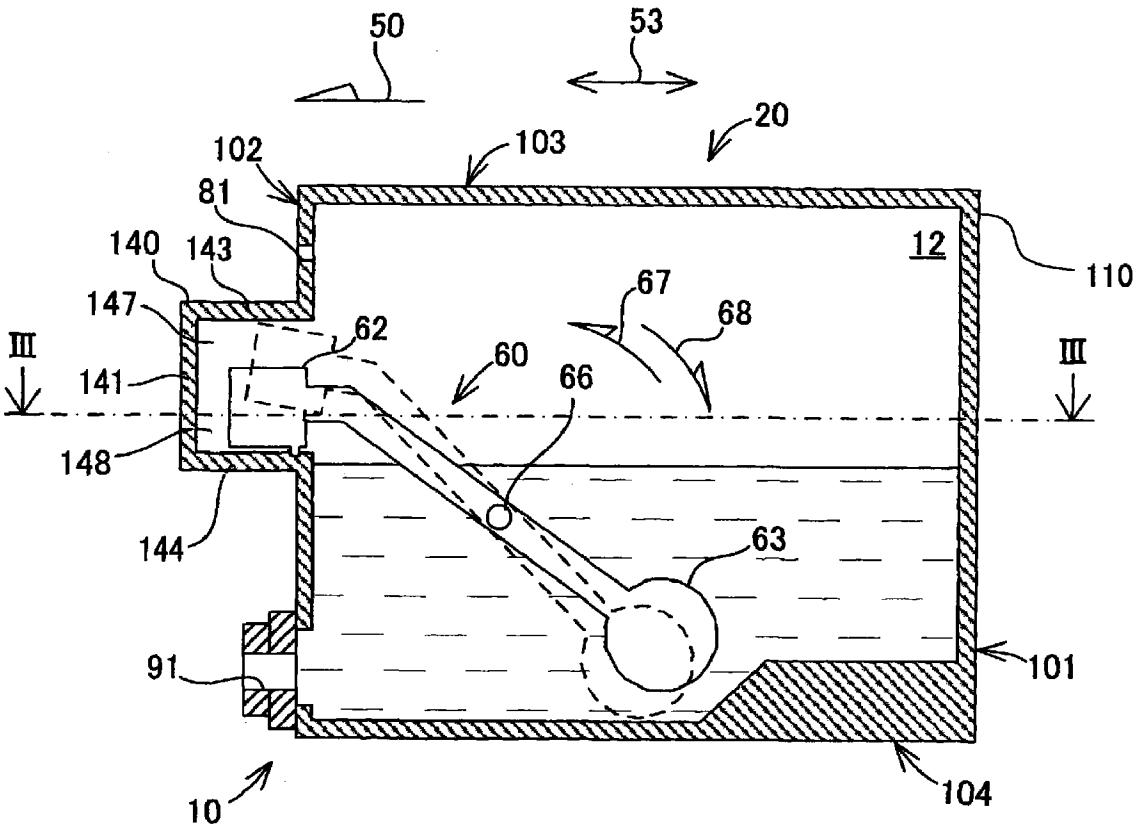
FIG. 2(B) is a cross-sectional view of the ink cartridge of FIG. 1.
Figure 2A:
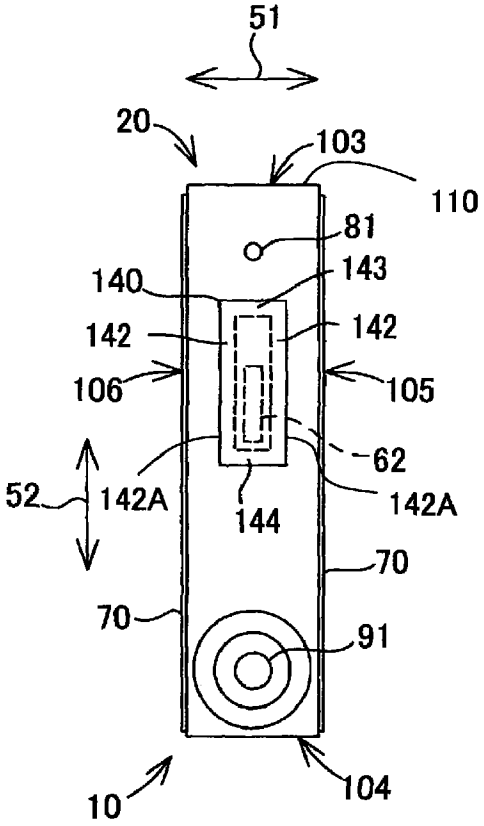
FIG. 2(A) is a front view of the ink cartridge of FIG. 1.

Referring to FIGS. 1-2(B), an ink cartridge 10 according to an embodiment of the present invention is depicted. The ink cartridge 10 may be configured to be used with an image recording apparatus, e.g., an ink-jet image recording apparatus. The ink cartridge 10 may be configured to store ink to be supplied to the image recording apparatus.

Figure 4A:
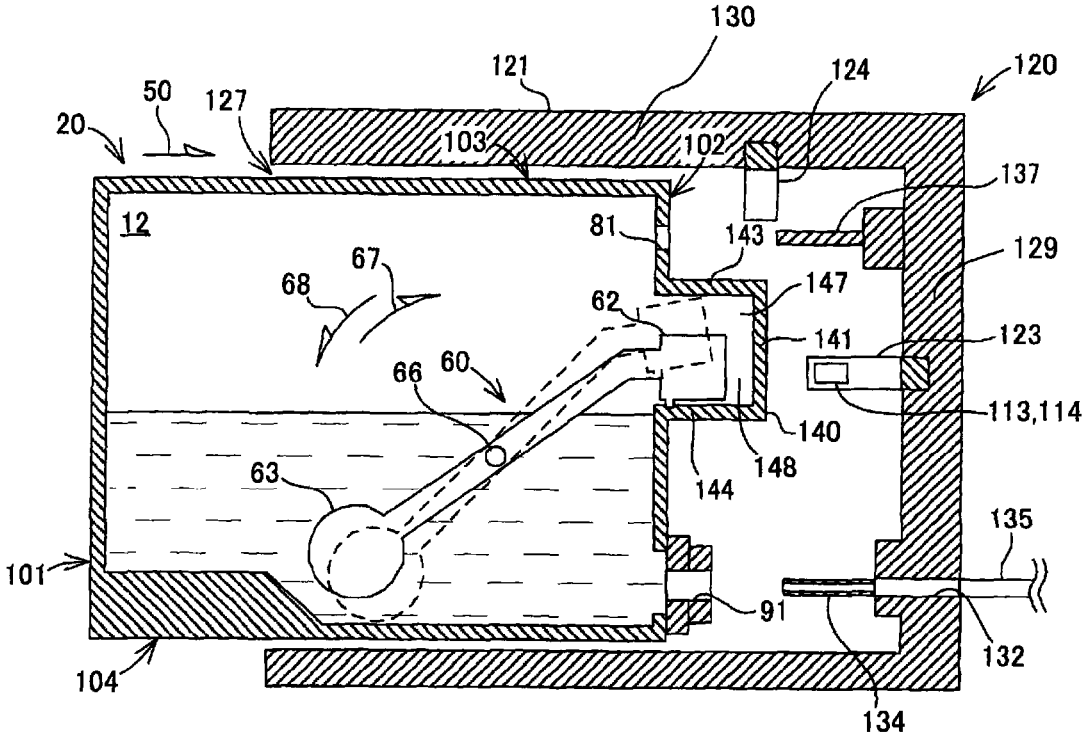
FIG. 4(A) is a cross-sectional view of an ink supply device according to an embodiment of the present invention, in which the ink cartridge is being inserted into a cartridge mounting portion of the ink supply device.
Figure 4B:
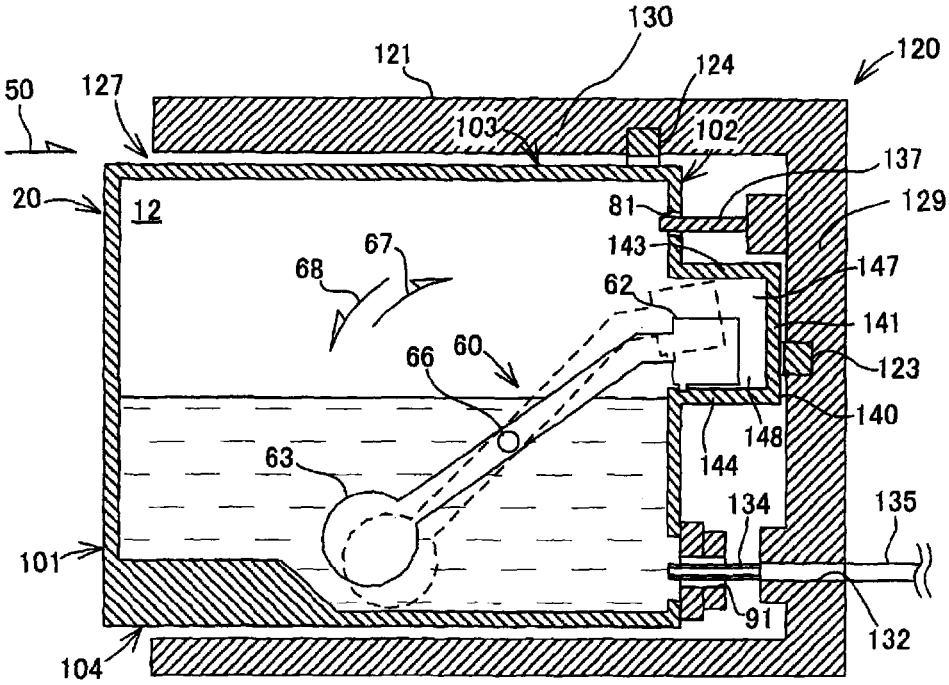
FIG. 4(B) is a cross-sectional view of the ink supply device, in which the insertion of the ink cartridge into the cartridge mounting portion is complete, and the ink cartridge is mounted to the cartridge mounting portion.

The ink cartridge 10 may have a flattened, substantially, rectangular parallelepiped shape having a width in a width direction 51, a height in a height direction 52, and a depth in a depth direction 53. The width of the ink cartridge 10 may be less than each of the height and the depth of the ink cartridge 10. Referring to FIGS. 4(A) and 4(B), the ink cartridge 10 may be configured to be inserted into a cartridge mounting portion 121 of the image recording apparatus in an insertion direction 50, which is parallel to the depth direction 53.

Referring again to FIGS. 1-2(B), the ink cartridge 10 may comprise a front face 102, a rear face 101 opposite the front face 102, a top face 103, a bottom face 104 opposite the top face 103, a left side face 105, and a right side face 106 opposite the left side face 105. When the ink cartridge 10 is inserted into the cartridge mounting portion 121, the ink cartridge 10 may be inserted from a front face 102 side. When the ink cartridge 10 is mounted to the cartridge mounting portion 121, the top face 103 may be positioned at the top of the ink cartridge 10 and the bottom face 104 may be positioned at the bottom of the ink cartridge 10. Each of an area of the left side face 105 and an area of the right side face 106 may be greater than each of an area of the front face 102, an area of the rear face 101, an area of the top face 103, and an area of the bottom face 104.

The ink cartridge 10 may comprise a case 20, a detection portion 140, a pivotable member 60, an air communication opening 81, and an ink supply opening 91. Ink cartridge 10 may comprise an outer case (not shown) covering substantially the entirety of the case 20, or a protector (not shown) covering the air communication opening 81 or the ink supply opening 91.

The case 20 may comprise a frame 110 and a pair of films 70. The frame 110 substantially may define the outer appearance. Therefore, the six faces 101-106 of the ink cartridge 10 may correspond to the six faces of the frame 110. In the following, the faces of the frame 110 are referred to using the reference numerals corresponding to the faces of the ink cartridge 10, respectively.

The frame 110 may comprise a semi-transparent resin material, such as nylon, polyethylene, polypropylene, or the like, and may be manufactured by injection-molding the resin material. The frame 110 may have a substantially, rectangular profile extending along the front face 102, the top face 103, the rear face 101, and the bottom face 104 to form a space inside. As a result, openings may be formed at the left side face 105 and the right side face 106 of the frame 110, respectively.

The pair of films 70 may be attached, e.g., welded or bonded with adhesive, to both ends of the frame 110 at the left side face 105 and the right side face 106, respectively, such that the openings of the frame 110 are covered by the pair of films 70, respectively. The frame 110 and the pair of films 70 may define an ink chamber 12 therein. The ink chamber 12 may be configured to store ink therein. In another embodiment, a frame may be a container having rigid six faces and an ink chamber may be formed in the container.

The frame 110 may comprise the detection portion 140 positioned at the front face 102 of the frame 110. The amount of ink stored in the ink chamber 12 may be observed visually or optically via the detection portion 140. The detection portion 140 may be integral with the frame 110. Therefore, the detection portion 140 may comprise the same material as the frame 110, i.e., a semi-transparent resin material.

The detection portion 140 may be positioned between the air communication opening 81 and the ink supply opening 91, and may extend outward from the front face 102 of the frame 110. The detection portion 140 may have a substantially, rectangular parallelepiped shape, and may comprise five rectangular walls. For example, detection portion 140 may comprise a front wall 141, a pair of side walls 142, a top wall 143, and a bottom wall 144. The front wall 141 may extend parallel to the front face 102 and may be separated from the front face 102 by a predetermined distance. The side walls 142 may be connected to the front face 102 and the front wall 141, the top wall 143 may be connected to top ends of the front wall 141 and the side walls 142, and the bottom wall 144 may be connected to bottom ends of the front wall 141 and the side walls 142. Moreover, the width of the front wall 141 may be less than the width of the front face 102. The detection portion 140 may have an inner space 147 defined by the front wall 141, the side walls 142, the top wall 143, and the bottom wall 144 inside the detection portion 140. The inner space 147 may be continuous with the ink chamber 12.

When the ink cartridge 10 is mounted to the cartridge mounting portion 121, the detection portion 140 may be positioned such that light emitted from an optical sensor 123, e.g., a photo-interrupter, of the cartridge mounting portion 121 is directed to the side walls 142.

The pivotable member 60 may be positioned in the case 20, more specifically, in the ink chamber 12. The pivotable member 60 may comprise a float portion 63 positioned at one end thereof, an indicator portion 62 positioned at the other end thereof, and a shaft 66 positioned between the indicator portion 62 and the float portion 63. The shaft 66 may be supported by a supporting portion (not shown) of the frame 110, such that the pivotable member 60 pivots about the shaft 66 in the ink chamber 12 in accordance with the amount of ink stored in the ink chamber 12.

The pivotable member 60 may comprise a light blocking resin material, such as nylon, polyethylene, polypropylene, polycarbonate, polyolefin, or acrylic resin, in which black pigment, such as carbon black, is added, such that when the pivotable member 60 is irradiated with light, e.g., visible or infrared light, the pivotable member 60 prevents at least a portion of the light from passing therethrough. At least indicator portion 62 of the pivotable member 60 may comprise light blocking material. In an embodiment, the entirety of the pivotable member 60 may comprise light blocking material. In another embodiment, the indicator portion 62 may comprise a prism, such that when the indicator portion 62 is irradiated with light, e.g., visible or infrared light, the indicator portion 62 alters a path of the light.

The float portion 63 may have a hollow portion formed therein, such that float portion 63 floats on ink. The float portion 63 may move up and down in accordance with the amount of ink stored in the ink chamber 12. The pivotable member 60 may be configured to pivot about the shaft 66 in accordance with the movement of the float portion 63. As long as the specific gravity of the float portion 63 is less than the specific gravity of ink stored in the ink chamber 12, such that the float portion 63 floats on ink, the float portion 63 need not have a hollow portion formed therein.

The indicator portion 62 of the pivotable member 60 may be positioned in the space 147 of the detection portion 140. The indicator portion 62 may move up and down in the space 147 in accordance with the pivotal movement of the pivotable member 60. The pivotable member 60 may be configured to pivot, such that the indicator portion 62 moves between a first position at which the indicator portion 62 contacts the bottom wall 144 and is separated from the top wall 143, as indicated by a solid line in FIG. 2(B), and a second position at which the indicator portion 62 is separated from the bottom wall 144 and contacts the top wall 143, as indicated by a broken line in FIG. 2(B).

When the float portion 63 moves up and down in accordance with the amount of ink stored in the ink chamber 12, the pivotable member 60 may pivot about the shaft 66, and the indicator portion 62 may move up and down in the space 147. More specifically, when the float portion 63 moves up, the pivotable member 60 may pivot about the shaft 66 in a direction indicated by an arrow 67 in FIG. 2(B), and the indicator portion 62 may move down in the space 147. When the indicator portion 62 reaches the bottom wall 144 of the detection portion 140, the indicator portion 62 may be positioned at the first position. When the indicator portion 62 is positioned at the first portion, the indicator portion 62 may be positioned at lower portion 142A of the side walls 142. The lower portion 142A may be a portion surrounded by a broken line in FIG. 1. When the indicator portion 62 is positioned at the first portion, light, e.g., visible or infrared light, directed to the lower portion 142A of one of the side walls 142A in a direction substantially perpendicular to the side wall 142A may pass through the lower portion 142A and may impinge the indicator portion 62. At least a portion of the light may be prevented from passing through the indicator portion 62. In another embodiment, the indicator portion 62 may comprise a prism, and the path of the light may be altered by the indicator portion 62.

When ink stored in the ink chamber 12 is consumed and the amount of ink becomes less than a predetermined amount of ink, the float portion 63 may move down in accordance with the amount of ink. Accordingly, the pivotable member 60 may pivot about the shaft 66 in a direction indicated by an arrow 68 in FIG. 2(B), and the indicator portion 62 may move up in the space 147. When the indicator portion 62 reaches the top wall 143, the indicator portion 62 may be positioned at the second position. When the indicator portion 62 is positioned at the second position, the indicator portion 62 may not be positioned at the lower portion 142A of the side walls 142. When light, e.g., visible or infrared light, is directed to the lower portion 142A of one of the side walls 142A in a direction substantially perpendicular to the side wall 142A when the indicator portion 62 is positioned at the second position, most or all of the light may pass through the lower portions 142A of the side walls 142A without being blocked or deflected by the indicator portion 62.

In this embodiment, when the ink cartridge 10 is mounted to the cartridge mounting portion 121, the lower portions 142A of the side walls 142A may be positioned between a light-emitting element 113 and a light-receiving element 114 of the optical sensor 123. When the indicator portion 62 is positioned at the first position, the indicator portion 62 may intersect an optical path 115 formed between the light-emitting element 113 and the light-receiving element 114, and light, e.g., visible or infrared light, emitted from the light-emitting element 113 toward the lower portion 142A of one of the side walls 142A may pass through the lower portion 142A and may impinge the indicator portion 62. At least a portion of the light may be prevented from passing through the indicator portion 62. In another embodiment, the indicator portion 62 may comprise a prism, and the path of the light may be altered by the indicator portion 62. When the indicator portion 62 is positioned at the second position, the indicator portion 62 may be away from the optical path 115, and most or all of the light emitted from the light-emitting element 113 toward the lower portion 142A of one of the side walls 142A may pass through the lower portions 142A of the side walls 142A and may reach the light receiving element 114. Thus, using the optical sensor 123, it may be determined whether the amount of ink stored in the ink chamber 12 is less than the predetermined amount of ink.

The air communication opening 81 may be formed through the front face 102 of the frame 110, and may be positioned between the top face 103 and the detection portion 140. The ink supply opening 91 may be formed through the front face 102 of the frame 110, and may be positioned between the bottom face 104 and the detection portion 140.

The interior of the ink chamber 12 may be in fluid communication with an exterior of the case 20 via the air communication opening 81. Before the ink cartridge 10 is used, the air communication opening 81 may be covered by a seal member (not shown) attached to the front face 102 of the frame 110 to prevent fluid communication between the interior of the ink chamber 12 and the exterior of the case 20 via the air communication opening 81. When a user intends to use the ink cartridge 10, the user may remove the seal member from the front face 102, such that fluid communication between the interior of the ink chamber 12 and the exterior of the case 20 via the air communication opening 81 is established. Thereafter, refers to FIG. 4, when the cartridge 10 is mounted to the cartridge mounting portion 121, a rod 137 of the cartridge mounting portion 121 may be inserted into the air communication opening 81.

Ink stored in the ink chamber 12 may be supplied to the exterior of the case 20 via the ink supply opening 91. Before the ink cartridge 10 is used, the ink supply opening 91 may be covered by a seal member (not shown) attached to the front face 102 of the frame 110 to prevent fluid communication between the interior of the ink chamber 12 and the exterior of the case 20 via the ink supply opening 91. When the ink cartridge 10 is mounted to the cartridge mounting portion 121, an ink needle 134 of the cartridge mounting portion 121 may pierce the seal member at the ink supply opening 91, such that ink may be supplied from the ink chamber 12 to a recording head (not shown) of the image recording apparatus via the ink needle 134.

In an embodiment, the seal members for covering the air communication opening 81 and the ink supply opening 91, respectively, may be stickers. In another embodiment, ink cartridge 10 may comprise valves configured to cover the air communication opening 81 and the ink supply opening 91, respectively, from the ink chamber 12 side by spring force.

Figure 3A:
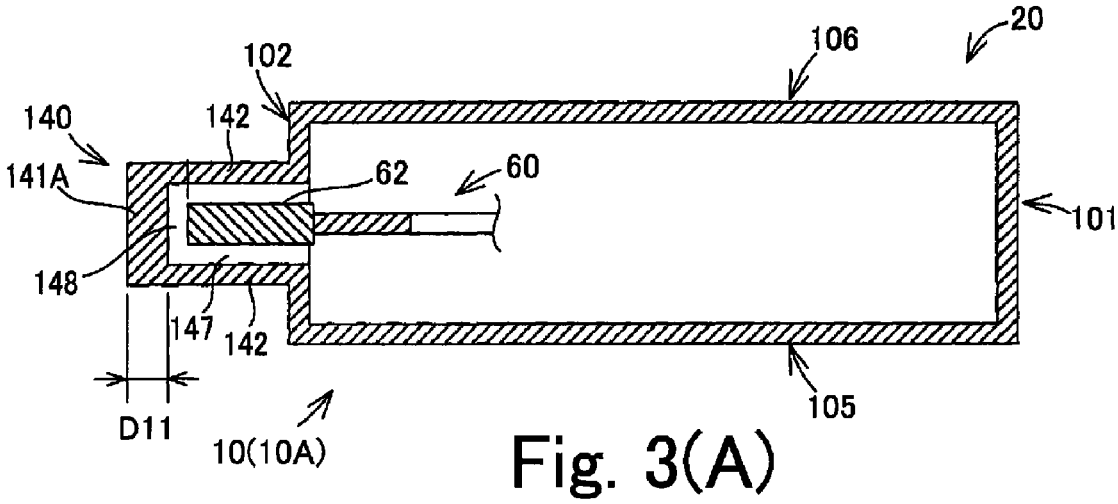
FIG. 3(A) is a cross-sectional view of the ink cartridge taken along line III-III of FIG. 2(B), in which the ink cartridge is a particular type of ink cartridge.

In this embodiment, the pivotable member 60 may be positioned, such that a front end of the indicator portion 62 is positioned in the rear of the front wall 141 of the detection portion 140 with respect to the insertion direction 50, as shown in FIG. 3(A). Most or all of the light emitted from the light-emitting element 113 of the optical sensor 123 may pass through a space 148 formed between the inner wall surface of the front wall 141 and the front end of the indicator portion 62, and may reach the light-receiving element 114 when the ink cartridge 10 is inserted into the cartridge mounting portion 121.

Figure 3B:
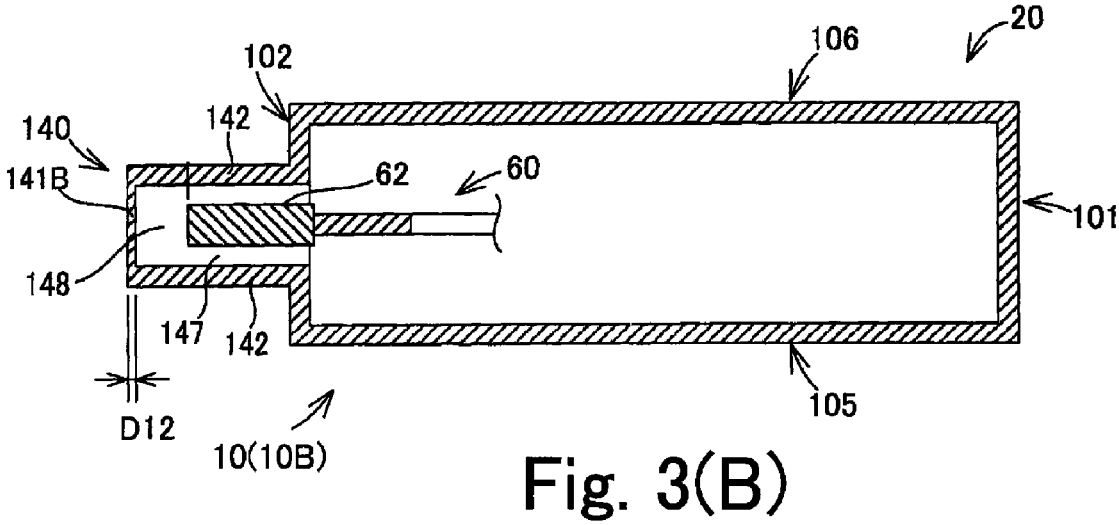
FIG. 3(B) is a cross-sectional view of the ink cartridge taken along line III-III of FIG. 2(B), in which the ink cartridge is a further type of ink cartridge.

In an embodiment, the ink cartridge 10 may be a particular type of ink cartridge 10A or a further type of ink cartridge 10B. The thickness of the front wall 141 in the depth direction 53 may differ between the ink cartridges 10A and 10B, such that the dimension of the space 148 in the depth direction 53 differs between the ink cartridges 10A and 10B. For example, the ink cartridge 10A may be a large-capacity type cartridge for business users who consume a large amount of ink, and the ink cartridge 10B may be a standard-capacity type cartridge for general consumers. The initial amount of ink stored in the ink chamber 12 of the ink cartridge 10A may be greater than the initial amount of ink stored in the ink chamber 12 of the ink cartridge 10B. In another embodiment, the color of ink stored in the ink chamber 12 may be different between the ink cartridges 10A and 10B. In yet another embodiment, the ink cartridge 10A may store dye ink, and the ink cartridge 10B may store pigment ink. In still another embodiment, the ink cartridge 10A may be sold in the United States, and the ink cartridge 10B may be sold in countries other than the United States. In an embodiment, the detection portion 140 of the ink cartridge 10A may comprise a front wall 141A having a thickness D11 in the depth direction 53, which is parallel to the insertion direction 50, as shown in FIG. 3(A), and the detection portion 140 of the ink cartridge 10B may comprise a front wall 141B having a thickness of D12 in the depth direction 53, which is parallel to the insertion direction 50, as shown in FIG. 3(B). The thickness D11 may be greater than the thickness D12.

Referring to FIGS. 4(A) and 4(B), an exemplary ink supply device 120 of the image recording apparatus is depicted. The ink supply device 120 may comprise at least one cartridge mounting portion 121 to which at least one ink cartridge 10 may be mounted, respectively.

The cartridge mounting portion 121 may have a substantially, rectangular parallelepiped shape. The cartridge mounting portion 121 may have an opening 127 formed therethrough, and an end wall 129 opposite the opening 127. An ink cartridge 10 may be inserted into the cartridge mounting portion 121 via the opening 127 toward the end wall 129 in the insertion direction 50.

Figure 7:
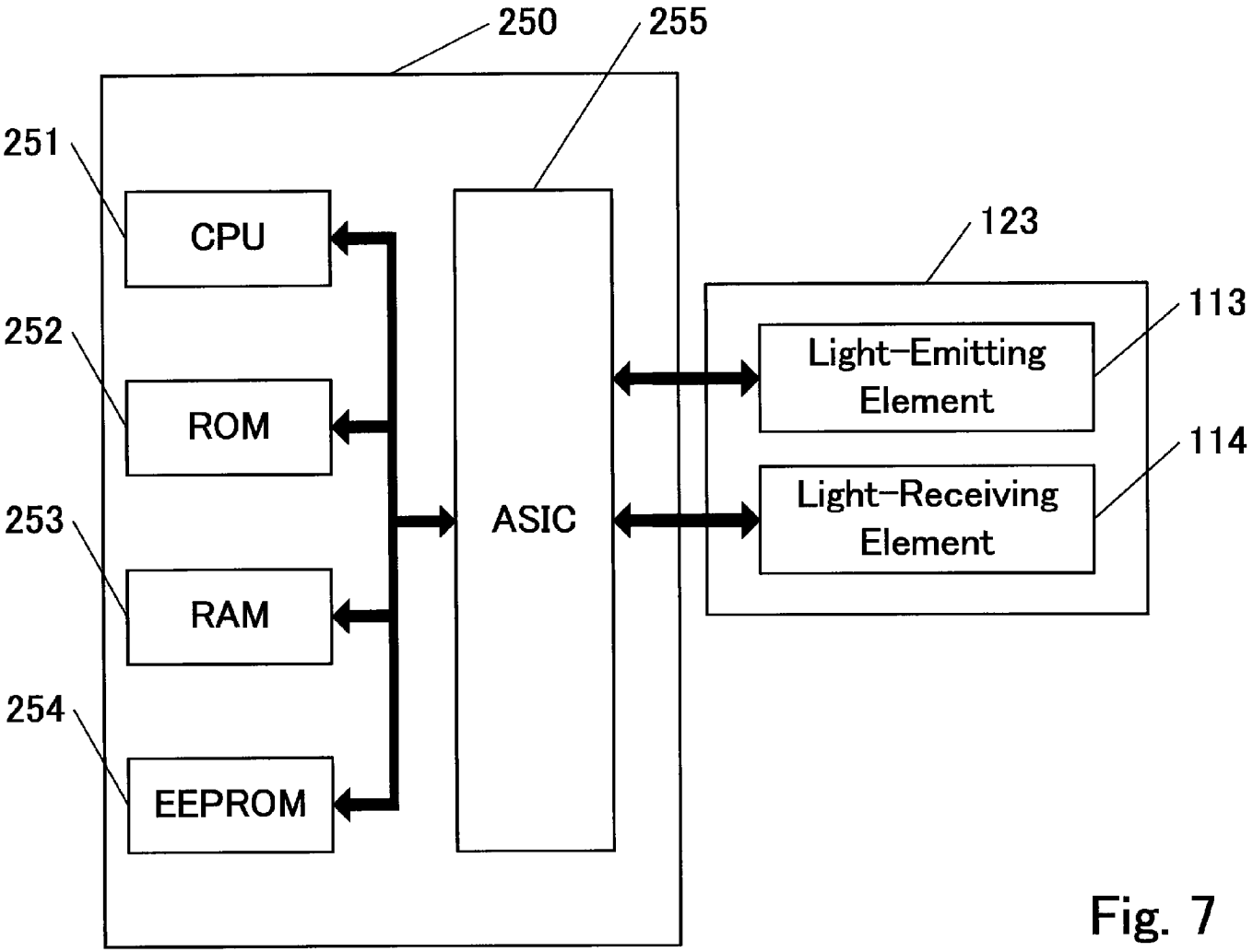
FIG. 7 is a block diagram of a controller of an image recording apparatus, according to an embodiment of the present invention.

Referring to FIG. 4(A)-FIG. 5(C), the cartridge mounting portion 121 may comprise the optical sensor 123 positioned at an inner surface of the end wall 129 of the cartridge mounting portion 121. As shown in FIG. 7, the optical sensor 123 may be connected to a controller 250. The optical sensor 123 may detect the front wall 141 of the detection portion 140, the lower portions 142A of the side walls 142 and the space 148, and the indicator portion 62. In this embodiment, the optical sensor 123 may be a photo-interrupter comprising the light-emitting element 113 and the light-receiving element 114 facing each other. The light emitting element 113 and the light-receiving element 114 may be aligned in the horizontal direction. The light emitting element 113 may be configured to emit light, e.g., visible or infrared light, toward the light-receiving element 114. When the ink cartridge 10 is mounted to the cartridge mounting portion 121, the lower portions 142A of the side walls 142 of the detection portion 140 may intersect the optical path 115 formed between the light-emitting element 113 and the light-receiving element 114.

When the intensity of light received by the light-receiving element 114 is greater than a threshold value, the optical sensor 123 may output a HIGH signal to the controller 250. On the contrary, when the intensity of light received by the light-receiving element 114 is less than or equal to the threshold value, the optical sensor 123 may output a LOW signal to the controller 250.

The cartridge mounting portion 121 may comprise a top wall 130 positioned at the top of the cartridge mounting portion 121. The cartridge mounting portion 121 also may comprise an optical sensor 124 positioned at an inner surface of the top wall 130 adjacent to the end wall 129. The optical sensor 124 may have substantially the same structure as the optical sensor 123. When the ink cartridge 10 is mounted to the cartridge mounting portion 121, a top wall of the ink cartridge 10 defining the top face 103 of the ink cartridge may be positioned between a light-emitting element and a light-receiving element of the optical sensor 124.

Similarly to the optical sensor 123, when the intensity of light received by the light-receiving element of the optical sensor 124 is greater than a threshold value, the optical sensor 124 may output a HIGH signal to the controller 250. On the contrary, when the intensity of light received by the light-receiving element of the optical sensor 124 is less than or equal to the threshold value, the optical sensor 124 may output a LOW signal to the controller 250.

The cartridge mounting portion 121 may have an opening 132 formed through the end wall 129 at a position adjacent to the bottom of the cartridge mounting portion 121. The opening 121 may extend from an outer surface of the end wall 129 to the inner surface of the end wall 129. The ink needle 134 may be connected to the opening 132 inside the cartridge mounting portion 121. When the ink cartridge 10 is mounted to the cartridge mounting portion 121, the ink needle 134 may be inserted into the ink supply opening 91. A flexible ink tube 135 may be connected to the opening 132 at the outer surface of the end wall 129.

The cartridge mounting portion 121 may comprise a rod 137 positioned at the inner surface of the end wall 129 adjacent to the top wall 130. When the ink cartridge 10 is mounted to the cartridge mounting portion 121, the rod 137 may be inserted into the air communication opening 81.

Referring to FIGS. 4(A)-5(C), a method of inserting the ink cartridge 10 into and mounting the ink cartridge 10 to the cartridge mounting portion 121 is depicted.

When the ink cartridge 10 is not mounted to the cartridge mounting portion 121, the optical path 115 of the optical sensor 123 may not be blocked, and light emitted from the light-emitting element 113 of the optical sensor 123 may reach the light-receiving element 114 of the optical sensor 123, such that the intensity of the light received by the light-receiving element 114 is greater than the threshold value. Therefore, the optical sensor 123 outputs the HIGH signal to the controller 250. Similarly, when the ink cartridge 10 is not mounted to the cartridge mounting portion 121, the optical path of the optical sensor 124 may not be blocked, and light emitted from the light-emitting element of the optical sensor 124 may reach the light-receiving element of the optical sensor 124, such that the intensity of the light received by the light-receiving element of the optical sensor 124 is greater than the threshold value. Therefore, the optical sensor 124 outputs the HIGH signal to the controller 250. When the ink cartridge 10 is not mounted to the cartridge mounting portion 121, the air communication opening 81 may be covered by the seal member (not shown), and the ink supply opening 91 may be covered by the seal member (not shown).

When the ink cartridge 10 is inserted into the cartridge mounting portion 121, the rod 137 may contact and break the seal member covering the air communication opening 81, and may be inserted into the air communication opening 81. Accordingly, fluid communication between the interior of the ink chamber 12 and the exterior of the case 20 via the air communication opening 81 may be established, such that the pressure in the ink chamber 12 may rise and become equal to the atmospheric pressure. When the ink cartridge 10 is further inserted into the cartridge mounting portion 121, the ink needle 134 may contact and pierce the seal member covering the ink supply opening 91, and may be inserted into the ink support opening 91. Accordingly, ink may be supplied from the ink chamber 12 to the recording head via the ink needle 134, the opening 132, and the ink tube 135.

In the process in which the ink cartridge 10 is inserted into the cartridge mounting portion 121, a front end of the top wall of the ink cartridge 10 may intersect the optical path formed between the light-emitting element and the light-receiving element of the optical sensor 124. The intensity of light emitted from the light-emitting element of the optical sensor 124 may decrease when the light passes through the top wall of the ink cartridge 10 because the thickness of the top wall of the ink cartridge 10 is relatively thick in the width direction 51. Therefore, the light emitted from the light-emitting element of the optical sensor 124 may not reach the light-receiving element of the optical sensor 124, such that the intensity of light received by the light-receiving element of the optical sensor 124 is less than the threshold value, or the intensity of light received by the light-receiving element of the optical sensor 124 may be less than or equal to the threshold value even if a portion of the light emitted from the light-emitting element of the optical sensor 124 reaches the light-receiving element of the optical sensor 124. Therefore, the optical sensor 124 may output the LOW signal to the controller 250. Based on whether the optical sensor 124 outputs the HIGH signal or LOW signal, the controller 250 may determine whether the ink cartridge 10 is mounted to the cartridge mounting portion 121.

Figure 5A:
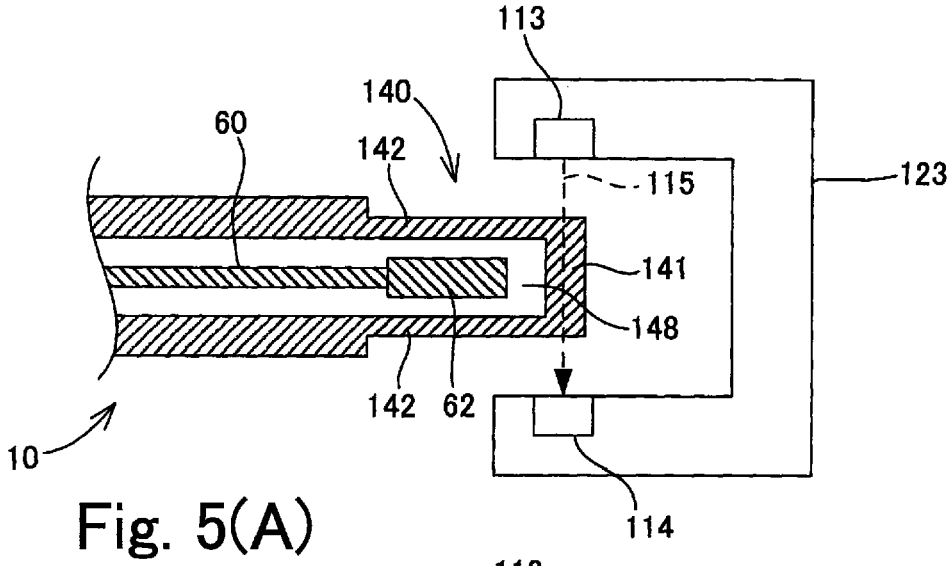
FIG. 5(A) is a cross-sectional view of the ink cartridge, similar to FIGS. 3(A) and 3(B), and a top view of an optical sensor, in which a front wall of a detection portion of the ink cartridge intersects an optical path of the optical sensor.

After the front end of the top wall of the ink cartridge 10 intersects the optical path of the optical sensor 124, the detection portion 140 may intersect the optical path 115 of the optical sensor 123. The front wall 141 first may intersect the optical path 115, as shown in FIG. 5(A). When this occurs, the intensity of light emitted from the light-emitting element 113 of the optical sensor 123 may decrease while the light passes through the front wall 141 of the detection portion 140 because the thickness of the front wall 141 is relatively thick in the width direction 51. Therefore, the light emitted from the light-emitting element 113 of the optical sensor 123 may not reach the light-receiving element 114 of the optical sensor 123, such that the intensity of light received by the light-receiving element 114 is less than the threshold value, or the intensity of light received by the light-receiving element 114 may be less than or equal to the threshold value even if a portion of the light emitted from the light-emitting element 113 reaches the light-receiving element 114. Therefore, the optical sensor 123 may output the LOW signal to the controller 250. In another embodiment, the front wall 141 may comprise a prism, and the front wall 141 may alter a path of the light emitted from the light-emitting element 113, such that the intensity of light received by the light-receiving element 114 may be less than or equal to the threshold value.

Figure 5B:
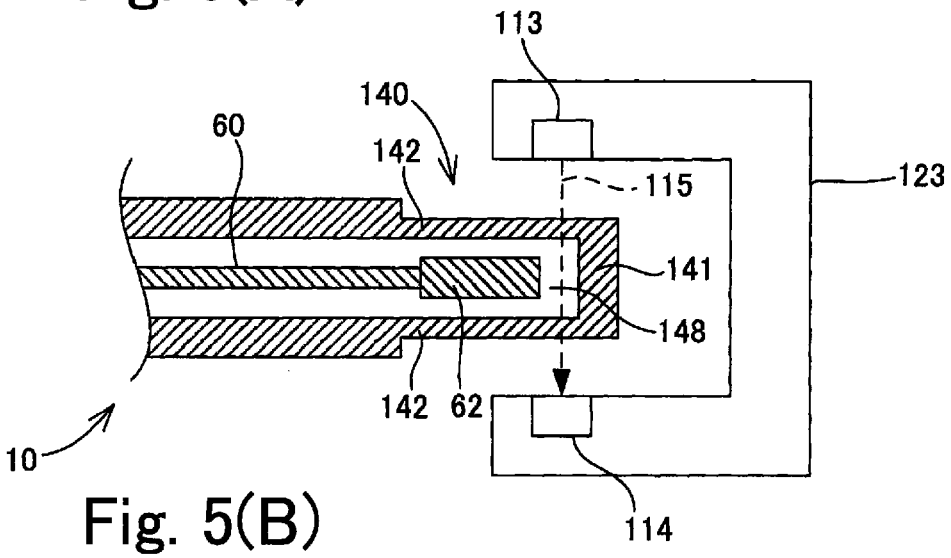
FIG. 5(B) is a cross-sectional view of the ink cartridge, similar to FIGS. 3(A) and 3(B), and a top view of an optical sensor, in which lower portions of side walls of the detection portion and a space between the front wall and an indicator portion of a pivotable member of the ink cartridge intersect the optical path.

Subsequently, when the ink cartridge 10 is further inserted, the lower portions 142A of the side walls 142 and the space 148 may intersect the optical path 115, as shown in FIG. 5(B). When this occurs, most or all of the light emitted from the light-emitting element 113 may pass through the lower portions 142A of the side walls 142 and the space 148, and may reach the light-receiving element 149, such that the intensity of light received by the light-receiving element 114 may be greater than the threshold value. Because the thickness of the side walls 142 is relatively thin in the width direction 51, the intensity of the light may not substantially decrease when the light passes through the lower portions 142 of the side walls 142, and the optical sensor 123 may output the HIGH signal to the controller 250.

Figure 5C:
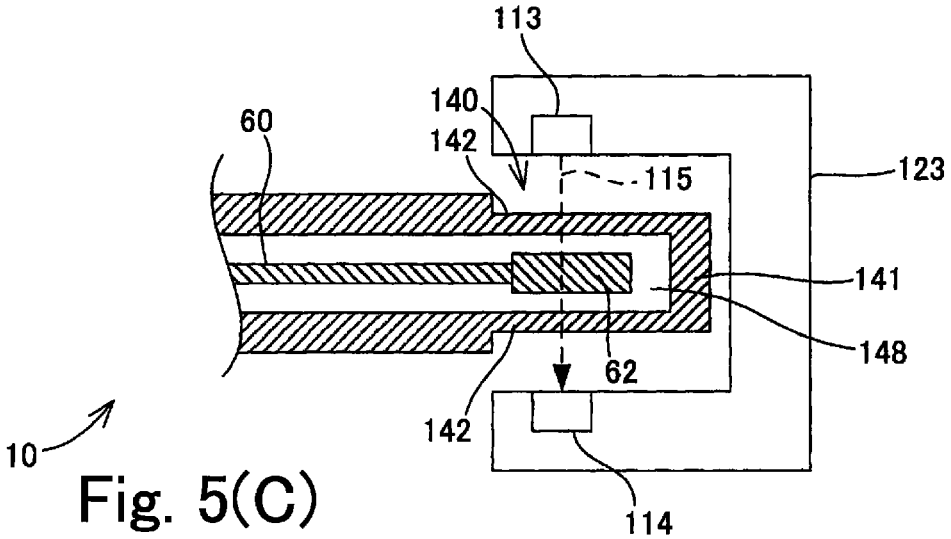
FIG. 5(C) is a cross-sectional views of the ink cartridge similar to ones in FIGS. 3(A) and 3(B) and a top view of an optical sensor, in which the indicator portion intersects the optical path.

Subsequently, when the ink cartridge is further inserted, the indicator portion 62 may intersect the optical path 115, as shown in FIG. 5(C). When this occurs, the light emitted from the light emitting element 113 may pass through the lower portion 142 of one of the side walls 142 and may impinge the indicator portion 62. At least a portion of the light may be prevented from passing through the indicator portion 62. Therefore, the light emitted from the light-emitting element 113 of the optical sensor 123 may not reach the light-receiving element 114 of the optical sensor 123, such that the intensity of light received by the light-receiving element 114 is less than the threshold value, or the intensity of light received by the light-receiving element 114 may be less than or equal to the threshold value even if a portion of the light emitted from the light-emitting element 113 reaches the light-receiving element 114. Therefore, the optical sensor 123 may output the LOW signal to the controller 250. In another embodiment, the indicator portion 62 may comprise a prism, and the indicator portion 62 may alter a path of the light emitted from the light-emitting element 113, such that the intensity of light received by the light-receiving element 114 less than or equal to the threshold value.

Figures 6A, 6B:
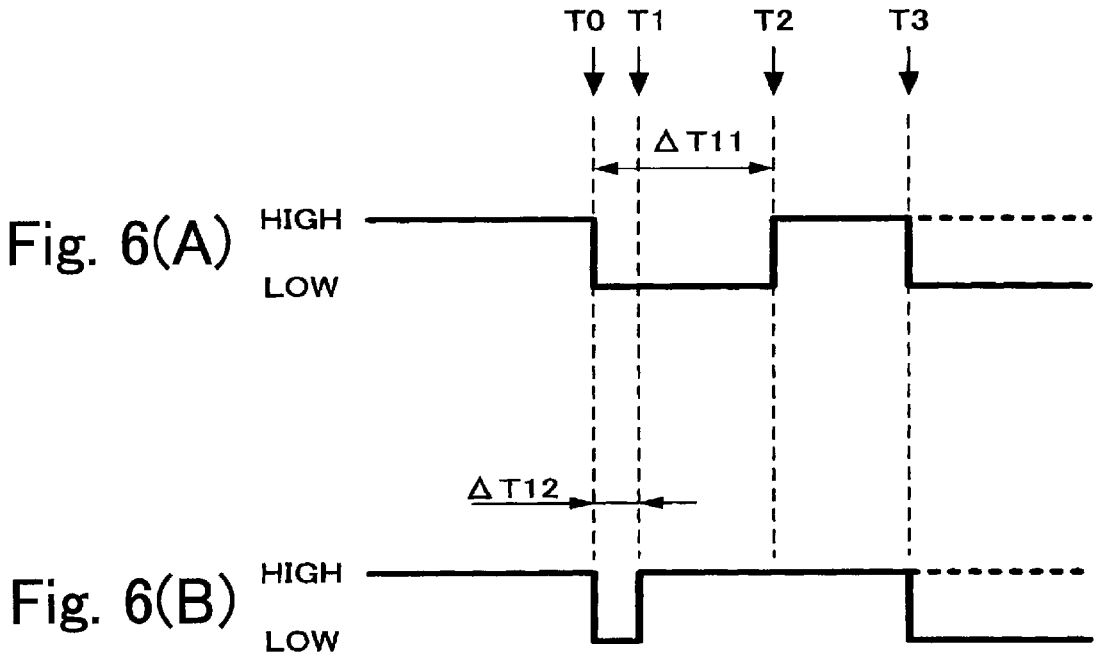
FIG. 6(A) is a time profile of a signal outputted from the optical sensor when the particular ink cartridge is inserted into the cartridge mounting portion.
FIG. 6(B) is the time profile of a signal outputted from the optical sensor when the further ink cartridge is inserted into the cartridge mounting portion.

Referring to FIGS. 6(A) and 6(B), time profiles of the signal outputted from the optical sensor 123 to the controller 250 when the ink cartridge 10 is inserted into the cartridge mounting portion 121 are depicted. FIG. 6(A) is a time profile of the signal outputted from the optical sensor 123 to the controller 250 when the ink cartridge 10A is inserted into the cartridge mounting portion 121, and FIG. 6(B) is a time profile of the signal outputted from the optical sensor 123 to the controller 250 when the ink cartridge 10B is inserted into the cartridge mounting portion 121.

Referring to FIGS. 6(A) and 6(B), when either one of the ink cartridges 10A or 10B is inserted into the cartridge mounting portion 121, the front wall 141A or 141B of the detection portion 140 may begin to be detected at a time T0, i.e., the front wall 141A or 141B may begin to intersect the optical path 115 at time T0, such that the signal changes from the HIGH signal to the LOW signal at time T0.

Referring to FIG. 6(A), when the ink cartridge 10A is inserted into the cartridge mounting portion 121, the front wall 141A, the lower portions 142A of the side walls 142 and the space 148, and the indicator portion 62 may sequentially intersect the optical path 115. The signal may remain as the LOW signal while the optical path 115 intersects the front wall 141A. At a time T2, the lower portions 142A of the side walls 142 and the space 148 may begin to intersect the optical path 115, such that the signal changes from the LOW signal to the HIGH signal. The time difference between time T0 and time T2 may be a time difference ΔT11. When the ink cartridge 10A is further inserted, the indicator portion 62 may begin to intersect the optical path 115 at a time T3, such that the signal changes from the HIGH signal to the LOW signal if the indicator portion 62 is positioned at the first position. When the indicator portion 62 is positioned at the second position, the indicator portion 62 may not intersect the optical path 115. Therefore, most or all of the light may reach the light-receiving element 114 at time T3, such that the signal remains as the HIGH signal as indicated by a broken line in FIG. 6(A). When the signal has been the HIGH signal for an amount of time greater than or equal to a predetermined amount of time since time T2, the controller 250 may determine that an empty ink cartridge 10A is mounted, and may indicate to a user that the amount of ink in ink cartridge 10A is less than a sufficient amount of ink.

Referring to FIG. 6(B), when the ink cartridge 10B is inserted into the cartridge mounting portion 121, the front wall 141B, the lower portion 142A of the side walls 142 and the space 148, and the indicator portion 62 may sequentially intersect the optical path 115. The signal may remain as the LOW signal while the optical path 115 intersects the front wall 141B. At a time T1, the lower portions 142A of the side walls 142 and the space 148 may begin to intersect the optical path 115, such that the signal changes from the LOW signal to the HIGH signal. The time difference between time T0 and time T1 may be a time difference ΔT12. Because the thickness D12 of the front wall 141B is less than the thickness D11 of the front wall 141A, the time difference ΔT12 may be less than the time difference ΔT11. When the ink cartridge 10B is further inserted, the indicator portion 62 may begin to intersect the optical path 115 at time T3, such that the signal changes from the HIGH signal to the LOW signal if the pivotable member 60 is positioned at the first position. When the pivotable member 60 is positioned at the second position, the indicator portion 62 may not intersect the optical path 115. Therefore, most or all of the light may reach the light-receiving element 114 at time T3, such that the signal remains as the HIGH signal, as indicated by a broken line in FIG. 6(B). When the amount of time that the signal has been the HIGH signal is greater than or equal to a predetermined amount of time since time T1, the controller 250 may determine that the amount of ink in the mounted ink cartridge 10B is less than a sufficient amount of ink, and may indicate to a user that the amount of ink in the mounted ink cartridge 10B is less than a sufficient amount of ink.

Referring to FIG. 7, the image recording apparatus may comprise the controller 250 configured to control the operation of the image recording apparatus. The controller 250 may be a microcomputer comprising a central processing unit (CPU) 251, a read only memory (ROM) 252, a random access memory (RAM) 253, an electrically erasable programmable read only memory (EEPROM) 254, and an application specific integrated circuit (ASIC) 255. CPU 251, ROM 252, RAM 253, EEPROM 254, and ASIC 255 may be electrically connected to each other, such that communication is established therebetween.

ROM 252 may store programs used by CPU 251 for controlling the respective operations of the image recording apparatus. RAM 253 may be a storage area or a work area for temporarily storing the respective data used by CPU 251 for executing the programs. EEPROM 254 may store settings, flags, or the like to be retained, even after the power is turned off.

The optical sensor 123 may be electrically connected to ASIC 255. More specifically, the light-emitting element 113 and the light-receiving element 114 of the optical sensor 123 may be electrically connected to ASIC 255. The light-emitting element 113 may be configured to emit light based on a driving signal sent from ASIC 255. The light-receiving element 114 may be configured to selectively output the High signal and the Low signal to ASIC 255. More specifically, the light receiving element 114 may be configured to output a signal, the electrical level of which, e.g., voltage value or current value, varies depending on the intensity of light received by the light receiving element 114. The controller 250 may determine that the signal is the HIGH signal if the electrical level of the signal is greater than a threshold value, and that the signal is the LOW signal if the electrical signal level of the signal is less than or equal to the threshold value.

Figure 8:
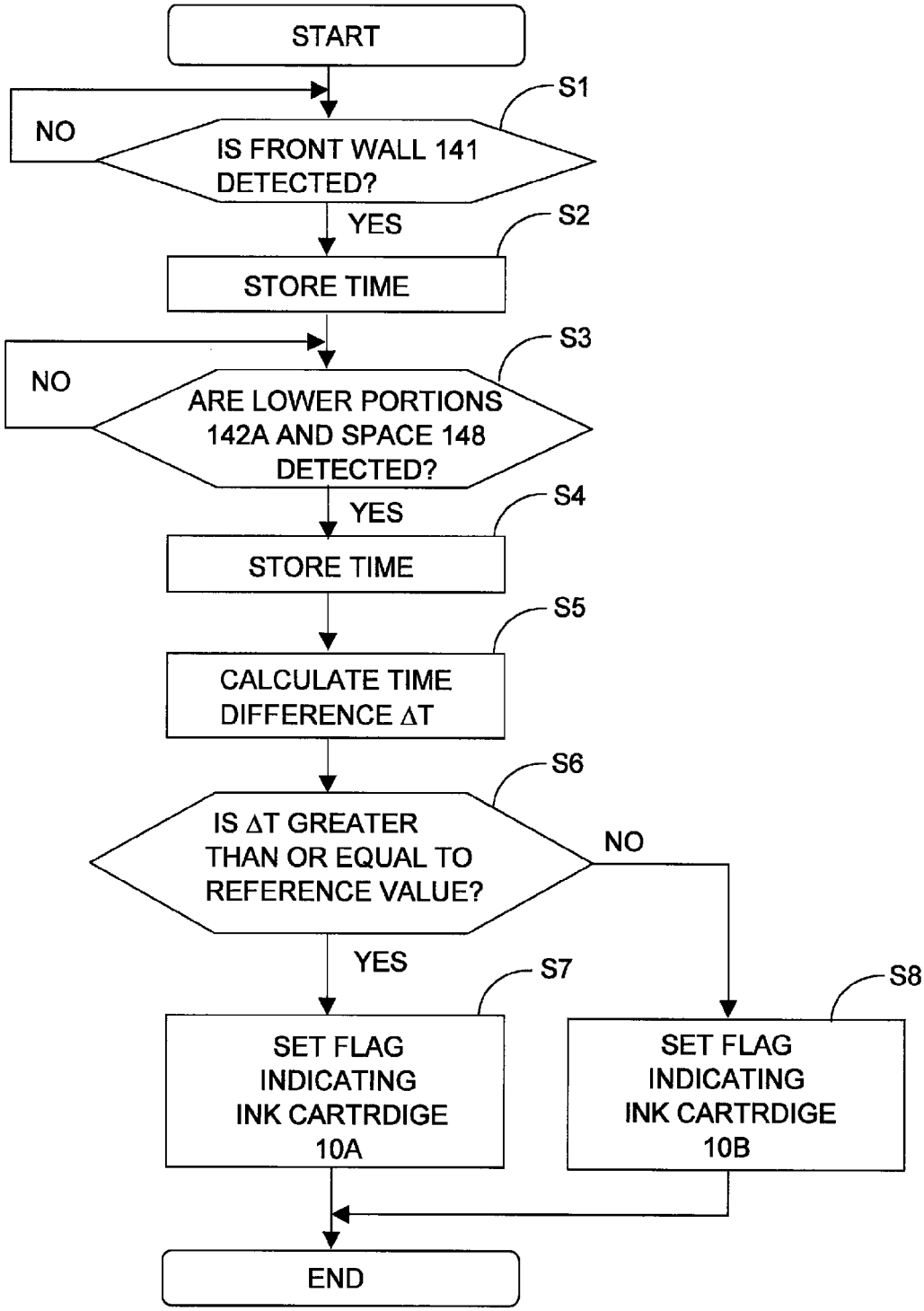
FIG. 8 is a flowchart of a procedure performed by the controller of FIG. 7, according to an embodiment of the present invention.

In this embodiment, the type of the ink cartridge 10 mounted to the cartridge mounting portion 121 may be determined by the controller 250 based on the signal outputted from the optical sensor 123. Referring to FIG. 8, the procedure of determining the type of ink cartridge 10 is depicted.

In Step S1, the controller 250 may determine whether the front wall 141 is detected, e.g., the controller 250 determines whether the signal outputted from the optical sensor 123 changes from the HIGH signal to the LOW signal. When the controller 250 determines that the front wall 141 is detected, then in Step S2, the controller 250 may store the time when the front wall 141 is detected in RAM 253. Step S1 may be repeated until the front wall 141 is detected.

Subsequently, in Step S3, the controller 250 may determine whether the lower portions 142A of the side walls 142 and the space 148 are detected, e.g., the controller 250 determines whether the signal outputted from the optical sensor 123 changes from the LOW signal to the HIGH signal. When the controller 250 determines that the lower portions 142A of the side walls 142 and the space 148 are detected, then in Step S4, the controller 250 may store the time when the lower portions 142A of the side walls 142 and the space 148 are detected in RAM 253. Step S3 may be repeated until the lower portions 142A of the side walls 142 and the space 148 are detected.

Subsequently, in Step 5, controller 250 may calculate the time difference ΔT based on the times stored in RAM 253. The time difference ΔT then may be compared to a reference value to determine whether the time difference ΔT is greater than or equal to the reference value in Step S6. In this embodiment, the reference value may be set based on statistics corresponding to the time difference ΔT11 when the ink cartridge 10A is inserted into the cartridge mounting portion 121, and statistics corresponding to the time difference ΔT12 when the ink cartridge 10B is inserted into the cartridge mounting portion 121. The reference value may be stored in RAM 203 in advance. Alternatively, it may be determined whether the time difference ΔT is within or outside a predetermined range in Step 6.

When it is determined in Step S6 that the time difference ΔT is less than the reference value, a bit flag indicating ink cartridge 10B may be set to a register of CPU 201 or RAM 203 in Step S8, and the procedure may end. If it is determined in Step S6 that the time difference ΔT is greater than or equal to the reference value, a bit flag indicating ink cartridge 10A may be set to a register of CPU 201 or RAM 203 in Step S7, and the procedure may end. In this embodiment, the controller 250 may determine that the initial amount of ink stored in the ink chamber 12 is relatively large when the controller 250 determines that the ink cartridge 10A is mounted in Step S7. The controller 250 also may determine that the initial amount of ink is relatively small when the controller 250 determines that the ink cartridge 10B is mounted in Step S8.

If the bit flag is set, the image recording apparatus or an information processing apparatus, e.g. a personal computer connected to the image recording apparatus, may display an indicator indicating which ink cartridge 10A or 10B is mounted to the cartridge mounting portion 121.

As described above, in this embodiment, during the insertion of the ink cartridge 10 into the cartridge mounting portion 121, the type of the ink cartridge 10 reliably and accurately may be determined based on the time profile of the signal outputted from the optical sensor 123. Moreover, the type of the ink cartridge 10 may be differentiated by varying the thickness of the front wall 141 from one type of the ink cartridge 10 to another type of ink cartridge 10.

In this embodiment, two types of the ink cartridge 10A and the ink cartridge 10B are differentiated. In another embodiment, more than two types of the ink cartridge 10 may be differentiated. In yet another embodiment, one type of the ink cartridge 10 which stores a pigment ink and another type of the ink cartridge 10 which stores a dye ink may be differentiated.

Figure 9:
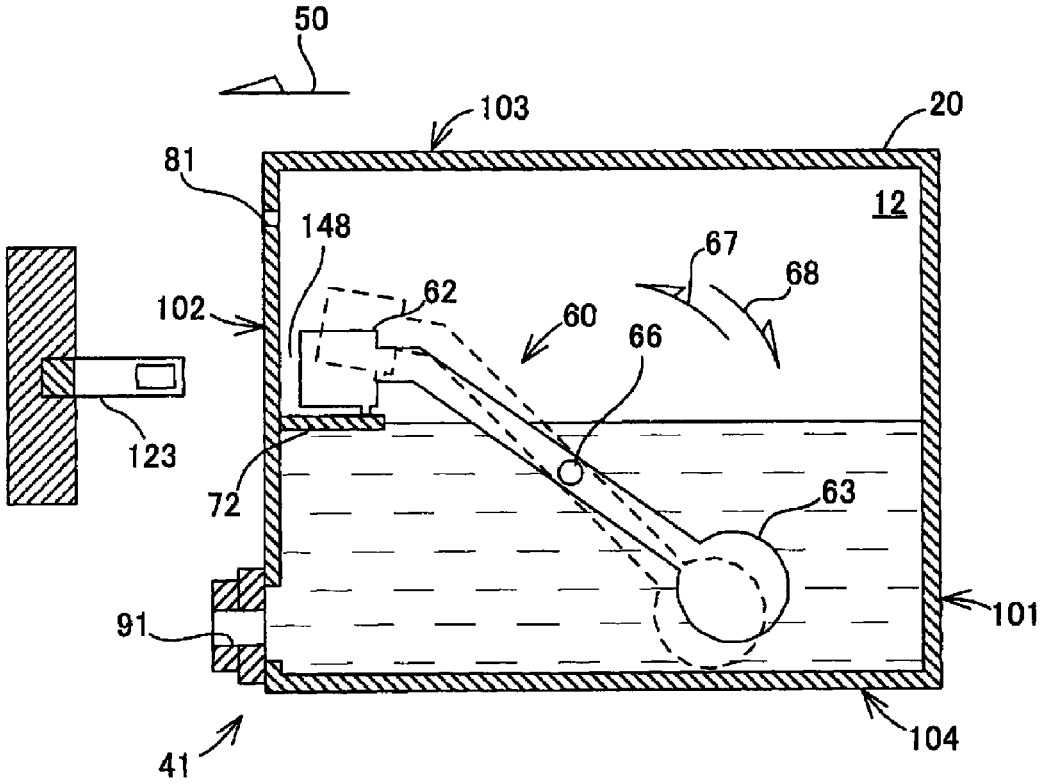
FIG. 9 is a cross-sectional view of an ink cartridge, according to another embodiment of the present invention.

Referring to FIG. 9, an ink cartridge 41 according to another embodiment of the present invention is depicted. The ink cartridge 41 may not comprise the detection portion 140. Accordingly, the pivotable member 60 may be entirely positioned in the ink chamber 12. A rib 72 may be positioned in the ink chamber 12, and the rib 72 may be configured to regulate downward movement of the indicator portion 62. When the pivotable member 60 pivots in the direction indicated by the arrow 67, the indicator portion 62 may contact the rib 72, and the pivotable member 60 may remain at a position at which the pivotable member 60 contacts the rib 72. When the indicator portion 62 contacts the rib 72, the space 148 may be formed between the inner wall surface of the front wall 102 and the front end of the indicator portion 62. The thickness of a front wall of the ink cartridge 41 defining the front face 102 may differ in the depth direction 53 from one type of the ink cartridge 41 to another type of the ink cartridge 41. When the ink cartridge 41 is inserted into the cartridge mounting portion 121, the controller 250 may determine the type of the ink cartridge 41.

Figure 10:
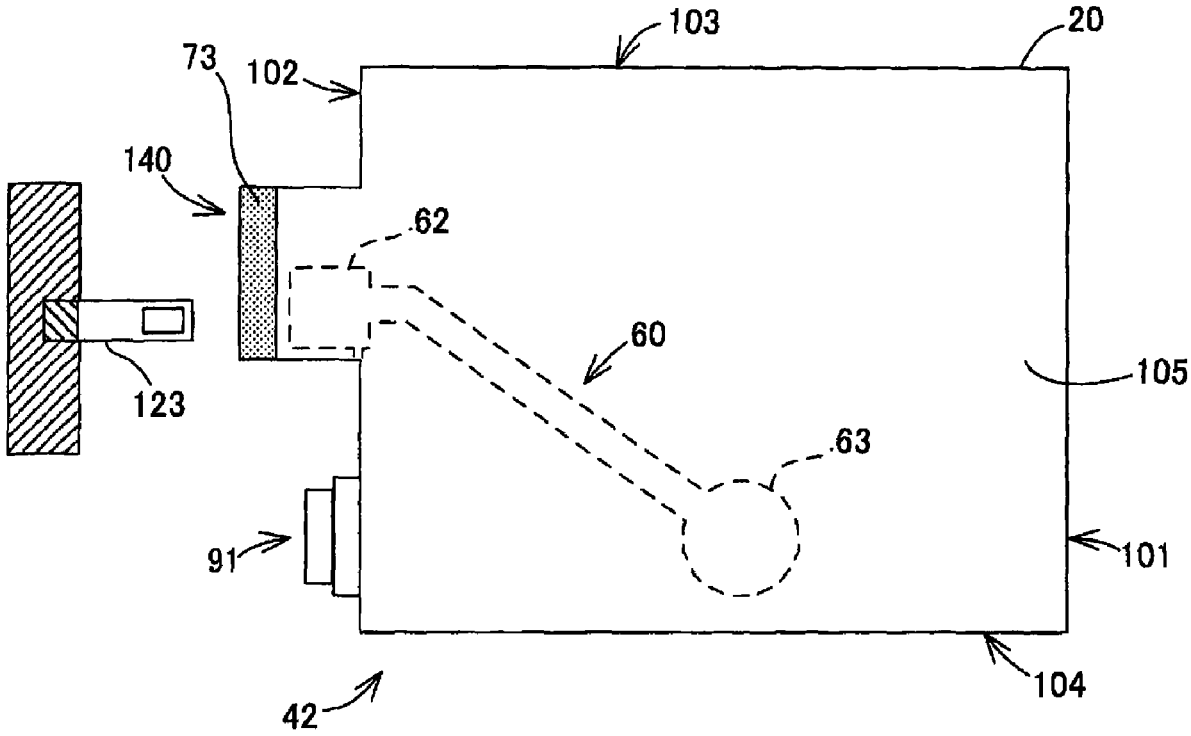
FIG. 10 is a cross-sectional view of an ink cartridge, according to yet another embodiment of the present invention.

Referring to FIG. 10, an ink cartridge 42 according to yet another embodiment of the present invention is depicted. The ink cartridge 42 may comprise a light blocking member, e.g., an aluminum foil 73, attached, e.g., bonded with adhesive, to one of the side walls 142. The aluminum foil 73 may be positioned adjacent to the front wall 141, such that a portion of the one of the side walls 142 to which the aluminum foil 73 is not attached is positioned between the aluminum foil 73 and the indicator portion 62 with respect to the depth direction 53, which is parallel to the insertion direction 50. In this embodiment, the thickness of the front wall 141 in the depth direction 53 may be the same independent of the type of the ink cartridge 42. Nevertheless, the thickness of the aluminum foil 73 in the depth direction 53 may differ from one type of the ink cartridge 42 to another type of the ink cartridge 42. When the ink cartridge 42 is inserted into the cartridge mounting portion 121, the controller 250 may determine the type of the ink cartridge 42.

Figure 11:
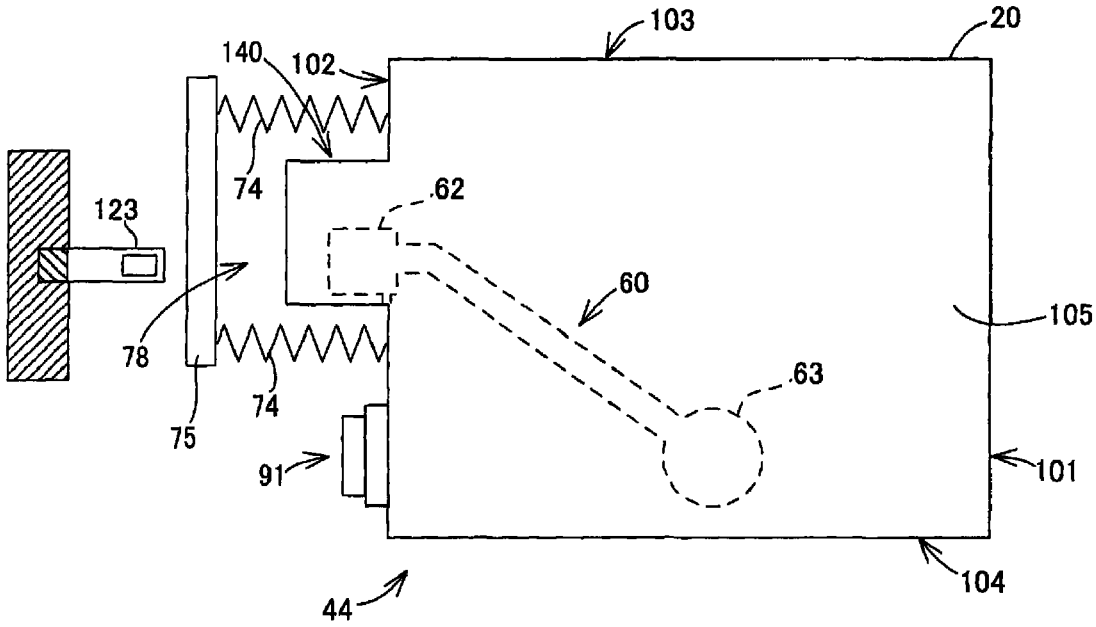
FIG. 11 is a cross-sectional view of an ink cartridge, according to still another embodiment of the present invention.

Referring to FIG. 11, an ink cartridge 44 according to still another embodiment of the present invention is depicted. The ink cartridge 44 may comprise a light blocking plate 75 coupled to the front face 102 via a pair of coil springs 74. When the coil springs 74 selectively expand and contract, the plate 75 may move toward and away from the front face 102, respectively. The detection portion 140 may be positioned between the coil springs 74 in the height direction 52. There may be a space 78 formed between the plate 75 and the front wall 141. In this embodiment, the thickness of the front wall 141 in the depth direction 53 may be the same independent of the type of the ink cartridge 44. Nevertheless, the thickness of the plate 75 in the depth direction 53 may differ from one type of the ink cartridge 44 to another type of the ink cartridge 44.

When the ink cartridge 44 is inserted into the cartridge mounting portion 121, the plate 75 may intersect the optical path 115 of the optical sensor 123. Subsequently, when the ink cartridge 44 is further inserted, coil springs 74 may contract, and the detection portion 140 may intersect the optical path 115 of the optical sensor. The controller 250 may then determine the type of the ink cartridge 44.

While the invention has been described in connection with various exemplary structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. An ink cartridge determination system comprising:

a cartridge mounting portion;

an optical sensor positioned at the cartridge mounting portion, wherein the optical sensor comprises:

a light-emitting element configured to emit a light; and a light-receiving element configured to receive the light emitted from the light-emitting element, wherein an optical path is formed between the light emitting element and the light-receiving element, and the optical sensor is configured to output a first signal when an intensity of the light received by the light-receiving element is greater than a threshold value, and to output a second signal when the intensity of the light received by the light-receiving element is less than or equal to the threshold value;

at least one ink cartridge configured to be inserted into the cartridge mounting portion in an insertion direction, wherein the at least one ink cartridge comprises:

a first light altering portion configured to permit a first amount of the light emitted from the light-emitting element to reach the light-receiving element, wherein an intensity of the first amount is less than or equal to the threshold value;

a second light altering portion configured to permit a second amount of the light emitted from the light-emitting element to reach the light-receiving element, wherein an intensity of the second amount is less than or equal to the threshold value; and a light passing portion configured to allow a third amount of the light emitted from the light-emitting element to pass therethrough and reach the light-receiving element, wherein an intensity of the third amount is greater than the threshold value, and the first light altering portion, the light passing portion, and the second light altering portion are configured to sequentially intersect the optical path of the optical sensor when the ink cartridge is inserted into the cartridge mounting portion; and a determiner configured to determine a type of the at least one ink cartridge based on a time profile of a signal outputted from the optical sensor during insertion of the at least one ink cartridge into the cartridge mounting portion.

2. The ink cartridge determination system of claim 1, wherein the at least one ink cartridge comprises a first ink cartridge and a second ink cartridge, and a shape of the first light altering portion of the first ink cartridge is different than a shape of the first light altering portion of the second ink cartridge.

3. The ink cartridge determination system of claim 2, wherein a thickness of the first light altering portion, in the insertion direction, of the first ink cartridge is different than a thickness of the first light altering portion, in the insertion direction, of the second ink cartridge.

4. The ink cartridge determination system of claim 3, wherein the determiner is configured to determine the type of the at least one ink cartridge based on a time period during which the first light altering portion blocks at least a portion of the light emitted from the light-emitting element.

5. The ink cartridge determination system of claim 1, wherein the ink cartridge further comprises an ink chamber configured to store ink therein, and the determiner is configured to determine an initial amount of ink stored in the ink chamber by determining the type of the at least one ink cartridge.

6. The ink cartridge determination system of claim 1, wherein the ink cartridge further comprises:

a case defining an ink chamber formed therein, wherein the at least one ink chamber is configured to store ink therein; and a plate positioned in front of the case with respect to the insertion direction, wherein the plate comprises the first light altering portion.

7. The ink cartridge determination system of claim 6, wherein the at least one ink cartridge further comprises at least one elastic member, and the plate is coupled to the case via the at least one elastic member.

8. The ink cartridge determination system of claim 1, wherein the at least one ink cartridge further comprises a case defining an ink chamber formed therein, and the ink chamber is configured to store ink therein, wherein the second light altering portion is positioned in the case, and is configured to move between a first position at which the second light altering portion intersects the optical path and a second position at which the second light altering portion is away from the optical path in accordance with an amount of ink stored in the ink chamber.

9. The ink cartridge determination system of claim 8, wherein the at least one ink cartridge further comprises a pivotable member positioned in the case, and the pivotable member is configured to pivot in accordance with the amount of ink stored in the ink chamber, wherein the second light altering portion is positioned at an end of the pivotable member, and is configured to move in accordance with a pivotal movement of the pivotable member.

10. An ink cartridge comprising:

a first light altering portion configured to permit a first amount of a light coming from a first side of the ink cartridge to reach a second side of the ink cartridge opposite the first side of the ink cartridge, wherein an intensity of the first amount is less than or equal to a predetermined value;

a second light altering portion configured to permit a second amount of the light coming from the first side of the ink cartridge to reach the second side of the ink cartridge, wherein an intensity of the second amount is less than or equal to the predetermined value; and a light passing portion configured to permit a third amount of the light coming from the first side of the ink cartridge to reach the second side of the ink cartridge, wherein an intensity of the third amount is greater than the predetermined value, and the first light altering portion, the light passing portion, and the second light altering portion are configured to sequentially intersect an optical path of the light wherein the first light altering portion is indicative of the type of the ink cartridge.

11. The ink cartridge of claim 10, further comprising an ink chamber configured to store ink therein, wherein the first light altering portion is indicative of an initial amount of ink stored in the ink chamber.

12. The ink cartridge of claim 10 further comprising:

a case defining at least one ink chamber formed therein, wherein the at least one ink chamber is configured to store ink therein; and a plate positioned in front of the case with respect to an insertion direction, wherein the plate comprises the first light altering portion.

13. The ink cartridge of claim 12, further comprising at least one elastic member, and the plate is coupled to the case via the at least one elastic member.

14. The ink cartridge of claim 10, further comprising a case defining an ink chamber formed therein, and the ink chamber is configured to store ink therein, wherein the second light altering portion is positioned in the case, and is configured to move between a first position at which the second light altering portion intersects the optical path and a second position at which the second light altering portion is away from the optical path in accordance with an amount of ink stored in the ink chamber.

15. The ink cartridge of claim 14, further comprising a pivotable member positioned in the case, and the pivotable member is configured to pivot in accordance with the amount of ink stored in the ink chamber, wherein the second light altering portion is positioned at an end of the pivotable member, and is configured to move in accordance with a pivotal movement of the pivotable member.

16. An ink cartridge comprising:

a first light altering portion configured to permit a first amount of a light coming from a first side of the ink cartridge to reach a second side of the ink cartridge opposite the first side of the ink cartridge, wherein an intensity of the first amount is less than or equal to a predetermined value;

a second light altering portion configured to permit a second amount of the light coming from the first side of the ink cartridge to reach the second side of the ink cartridge, wherein an intensity of the second amount is less than or equal to the predetermined value;

a light passing portion configured to permit a third amount of the light coming from the first side of the ink cartridge to reach the second side of the ink cartridge, wherein an intensity of the third amount is greater than the predetermined value, and the first light altering portion, the light passing portion, and the second light altering portion are configured to sequentially intersect an optical path of the light;

a case defining at least one ink chamber formed therein, wherein the at least one ink chamber is configured to store ink therein;

a plate positioned in front of the case with respect to an insertion direction, wherein the plate comprises the first light altering portion; and at least one elastic member, wherein the plate is coupled to the case via the at least one elastic member.

* * * * *